United States Patent [19]

Michelet et al.

[11] 4,183,508

[45] Jan. 15, 1980

[54] METALLURGICAL INDUCTION HEATING APPARATUS

[75] Inventors: Jacques Michelet, Metz; Hugues Zanetta, St-Julien-les-Metz, both of France

[73] Assignee: Institut de Recherches de la Siderurgie Francaise, Saint-Germain-en-Laye, France

[21] Appl. No.: 839,316

[22] Filed: Oct. 4, 1977

[30] Foreign Application Priority Data

Oct. 4, 1976 [FR] France ..... 76 29996
Nov. 16, 1976 [FR] France ..... 76 34679

[51] Int. Cl.[2] ..... F27B 14/00; F27B 14/06

[52] U.S. Cl. ..... 266/242; 13/27; 13/32; 266/275

[58] Field of Search ..... 13/26, 27, 32, 35; 266/242, 275, 276; 432/156–158, 262–265

[56] References Cited

U.S. PATENT DOCUMENTS 3,461,215 8/1969 Reboux ..... 13/27
3,703,601 11/1972 Babel ..... 13/27
4,058,668 11/1977 Clites ..... 13/32

*Primary Examiner*—Gerald A. Dost
*Attorney, Agent, or Firm*—Michael J. Striker

[57] ABSTRACT

A metallurgical induction heating apparatus has an upwardly cupped induction coil having a housing formed with an upper rim and containing a heavy-duty coil. A crucible formed of a metallic base pan and a metallic holding collar interconnected by a plurality of upright tubular tierods so as to clamp a multiplicity of refractory bricks has an annular upper support body which extends outwardly beyond an upper mounting ring to which the upper ends of the tierods are connected and which rests on the rim of the induction heater. Means is provided for circulating a coolant fluid upwardly through the tierods and into an annular compartment formed inside the support body. A hood may be placed over this arrangement in gas-tight contact with the upper surface of the annular body so that the interior of the crucible can be evacuated or filled with an inert gas.

9 Claims, 5 Drawing Figures

METALLURGICAL INDUCTION HEATING APPARATUS

BACKGROUND OF THE INVENTION

The present invention relates to a metallurgical induction heating apparatus. More particularly this invention concerns a crucible for an induction heating apparatus.

An induction heating apparatus has a crucible that is lined with refractory material and that is externally surrounded by a heavy-duty electric coil. Metal or metal alloy to be melted is loaded into the crucible and alternating current is passed through the coil so that a moving electromagnetic field is formed within the crucible. Thus eddy currents are generated in the metal to be melted so that the metal heats up and eventually melts.

A considerable problem in such installations is that it is necessary to heat the metal contained in the crucible without heating the crucible itself. Thus when a standard crucible constituted as a large metallic vessel lined with refractory material is used it becomes very difficult to limit the heating effect to the metal contained in the crucible. By using a very low frequency, between 1 and 5 Herz, it is possible to limit the electromagnetic heating of the crucible, while augmenting the heating of the metal by means of another heating means such as a direct electric arc or the like. Thus in such a situation the low-frequency field serves mainly to mix and circulate the metal in the crucible.

It is, however, much more desirable to use standard-frequency electrical energy at 50 or even 60 Herz. The heating effect in the crucible can be greatly reduced by forming the crucible of a multiplicity of separate wall elements separated by mortar-like webs of insulating material. Such a system can be used without auxiliary heating and without excessive heating of the crucible. Such an arrangement does, however, have the disadvantage that the crucible is extremely expensive and leak-prone.

It is also known, as for example shown in French Pat. No. 1,509,043 or French Pat. No. 1,534,905 to form the crucible, at least in the region of the coil, of a multiplicity of separate non-magnetic metallic plates. Once again refractory cement is injected between these plates to hold the assembly together. Such an arrangement has a relatively short service life and when used above frequencies of 60 Herz heats excessively.

French Pat. No. 2,100,553 shows several induction heating arrangements. One of these clamps the lining of refractory material between an upper collar and a lower base pan. The collar and base pan are provided with outwardly projecting mounting rings that are vertically interconnected by a plurality of vertically extending tierods. These tierods are electrically insulated from each other and from the mounting rings so that they form an open circuit. Such an arrangement therefore clamps the refractory bricks constituting the lining in an extremely rigid fashion. However it has the disadvantage that when used in a very heavy-duty installation the vertically extending tierods are still extensive enough to heat excessively. Obviously when heated too much these tierods lengthen and, therefore, reduce their clamping action so that the metal being melted can enter between the refractory bricks.

SUMMARY OF THE INVENTION

It is therefore an object of the present invention to provide an improved induction heating apparatus.

Another object is to provide a removable crucible usable in such an apparatus.

Yet another object is to provide an induction heating device which overcomes the above-given disadvantages, that is which can be used with a relatively powerful electromagnetic field at relatively high frequency without excessive heating of the parts forming the crucible.

These objects are attained according to the present invention in a crucible of the above-described general type, that is having a refractory lining clamped by tierods extending between mounting rings on an upper collar and lower base pan. In accordance with the invention these tierods are tubular and means is provided for circulating a coolant fluid through them.

According to another feature of this invention the crucible is provided on its upper collar with an outwardly extending body or flange which projects horizontally beyond the tierods and mounting rings, and whose lower side rests on the upper rim of the upwardly cupped induction heater carrying the induction coil. This body is annular and hollow, and the tierods are connected via expansible connections to the interior of this body so that an efficient fluid-circulation path is formed.

Such an arrangement has several advantages. First of all the generation of Foucault currents in the tierods is reduced to a negligible minimum. Furthermore what little Eddy currents and the like are generated in the tierods do not have a dangerous heating effect, as these tierods are themselves specifically cooled. Finally the tubes, which as is usual are produced by cold working, are substantially as strong as the normally solid rods they replace, which as is usual are normally produced by hot working. According to this invention these tubes are standard stainless-steel items readily available and easily adapted for use in the crucible construction.

It is also possible according to the present invention to use the above-described system in a combination with a cover or hood which allows the space defined within the crucible and cover to be at least partially evacuated and/or filled with an inert gas or particular treatment gas. Such an arrangement allows the apparatus according to the present invention to be used in any of a multiplicity of different processes. For instance the system can be used to deoxidize, degas or decarburize a melt.

To achieve this effect a crucible as described above is employed, with a blower or the like connected to the lower ends of the tierods for blowing the coolant fluid vertically up through them. The upper ends of these tierods, as mentioned above, are connected to the annular compartment within the body by means of which the crucible rests in the induction heater. This annular compartment is open at a plurality of throughgoing apertures to the ambient atmosphere so that air blown upwardly through the tierods is collected in this compartment and passes outwardly, without having to be aspirated by the hood or cover fitted over the crucible. It is also possible in accordance with this invention to subdivide the housing of the induction heater into a pair of chambers, one of which contains the coil itself. This chamber may be vented directly to the atmosphere, or may be connected to the aspiration hood so that the pressure therein can be reduced and, once again, the operating efficiency of the assembly can once again be increased.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
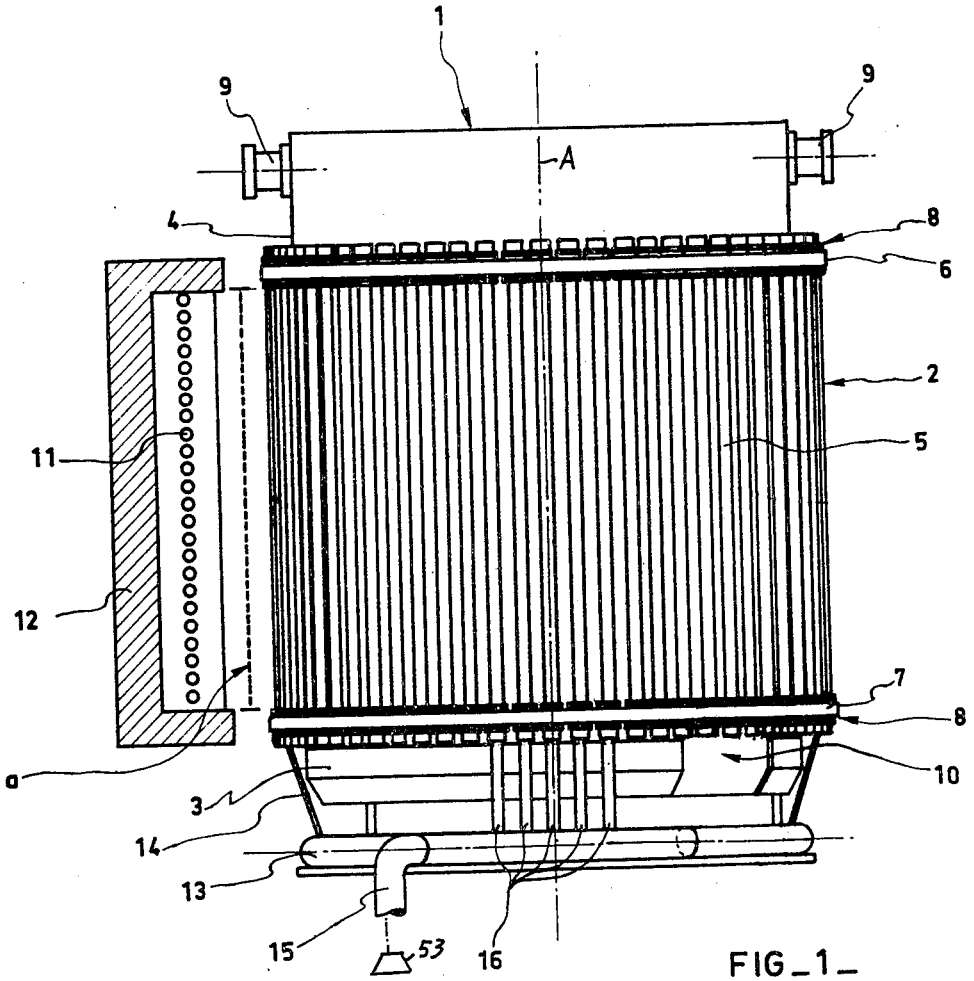
FIG. 1 is a side view of a crucible according to this invention, showing the induction heater partly in section.

As shown in FIG. 1 a crucible 1 has a side 2 of generally cylindrical shape and a base pan 3. At its upper end the side 2 is constituted by a collar 4 and tubular stainless-steel tierods 5 interconnect a mounting ring 6 fixed to the collar 4 and an identical mounting ring 7 fixed to the base pan 3, with securing means in the form of nuts 8 holding the tierods 5 tightly vertically in place. The collar 4 is also provided with pivots or gudgeons 9 permitting the crucible 1 to be picked up and tipped about the diametral axis defined by these pivot pins 9. The entire assembly is upwardly cylindrical and centered on a vertical axis A.

The base pan 3 has a slide valve 10 allowing tapping of a melt within the crucible 1. In addition a coil 11 having a vertical height a is held in a housing 12 and annularly surrounds the crucible 1. The height a is equal to the vertical distance between the upper surface of the lower ring 7 and the lower surface of the upper ring 6.

A manifold 13 is hung below the base pan 3 by means of struts or straps 14 and is connected via a pressurized feed conduit 15 to a blower 53. In addition short connecting conduits 16 extend between this annular manifold 13 and the lower end of each of the tubular tierods 5. Thus the blower 53 will force relatively cool ambient air upwardly through the tierods 5 so that this air exits from the upper exposed end 17 thereof.

It is, of course, possible to provide the manifold 13 at the upper end of the rods 5, in which case the flow of coolant will be downwardly out through the bottom ends thereof.

A crucible according to this invention has been made with the capacity of 7 tons of liquid steel, having a diameter of approximately 1.5 m and having 60 tierods 5 angularly equispaced about the axis A. The overall sectional area of the rods 5 is therefore equal to approximately half of the area of the spaces between them. These rods are spaced apart by wedges of insulating material as described in the copending patent application No. 839,318, now abandoned, of the same inventors filed approximately contemporaneously with this application and whose entire disclosure is herewith incorporated by reference.

In the described example the rods 5 are of cylindrical shape, having an external diameter of 3.3 cm and an internal diameter of 1.7 cm so that their wall thickness is 0.8 cm.

Figure 2:
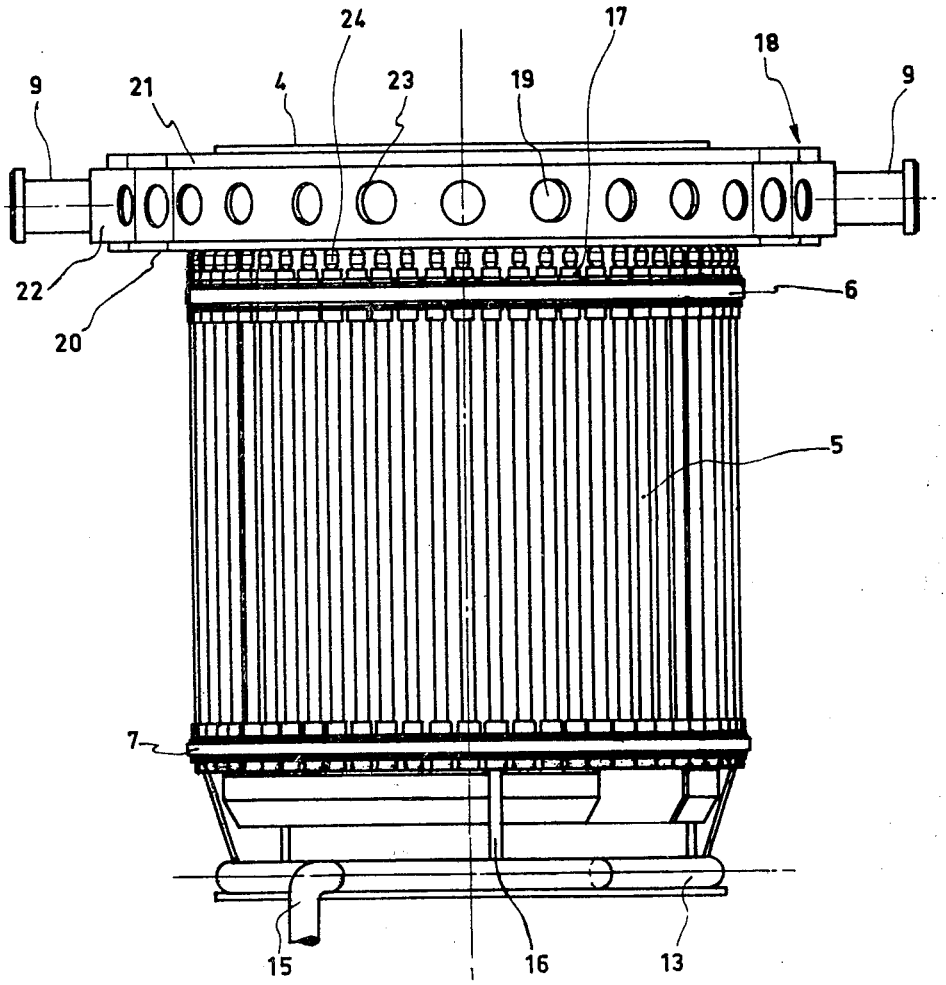
FIG. 2 is a side view through another crucible in accordance with this invention.
Figure 3:
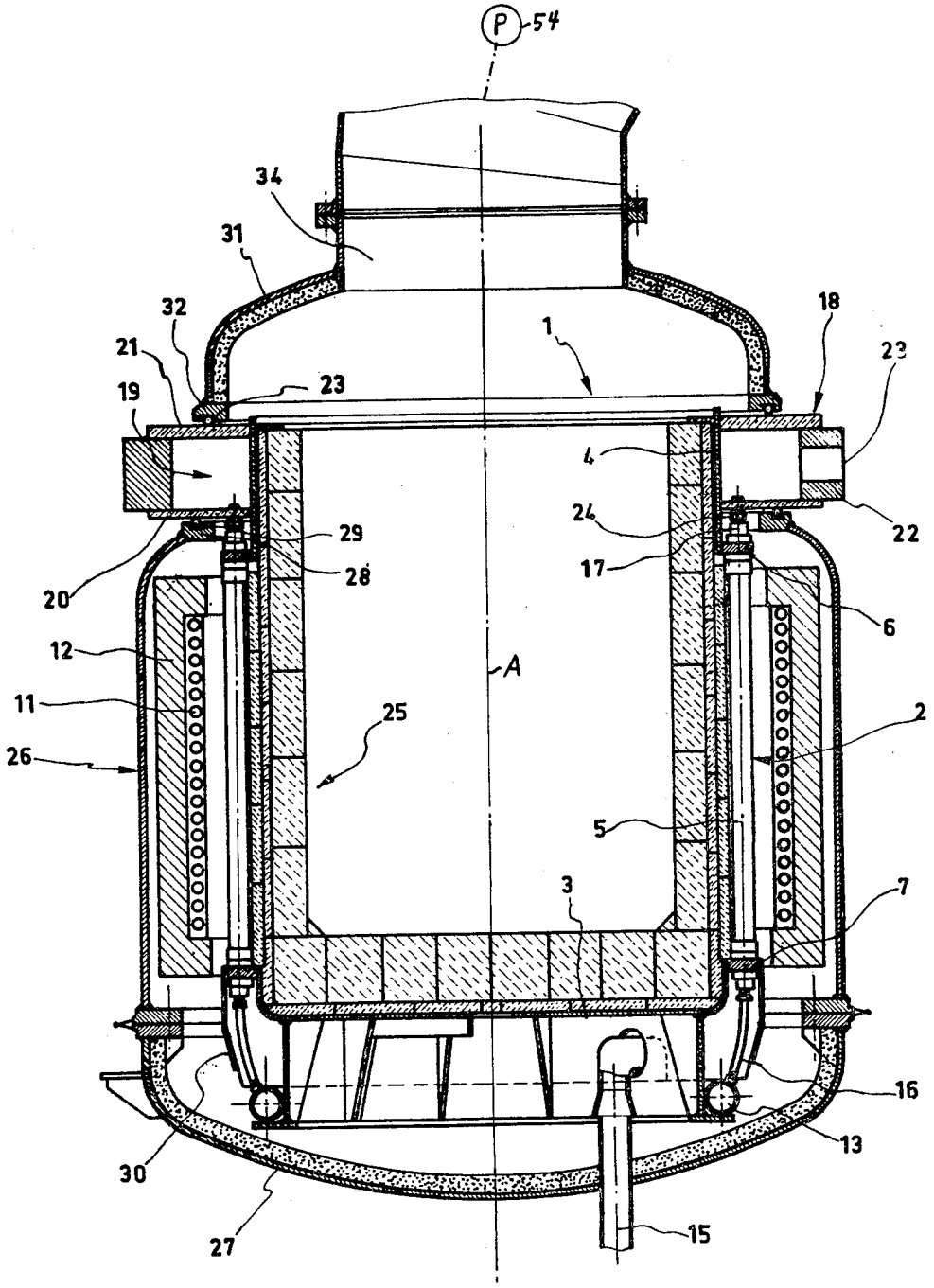
FIG. 3 is a vertical section through a crucible and induction heater according to the instant invention and generally as shown in FIG. 2.
Figure 5:
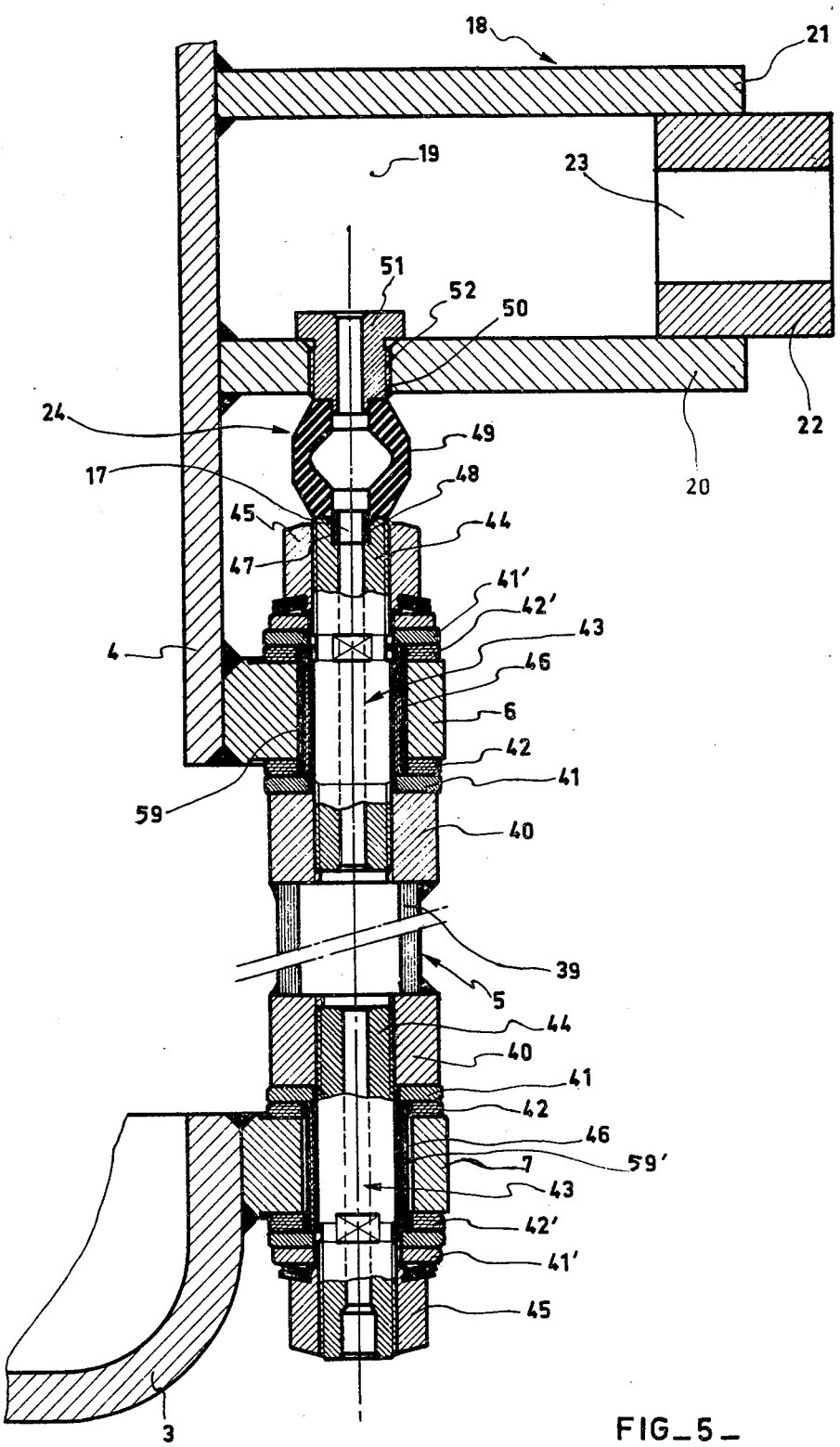
FIG. 5 is a large-scale view of a detail of FIG. 3.

Reference numerals from FIG. 1 are used in FIGS. 2, 3 and 5 wherever the structure is virtually identical. In this arrangement, however, the collar 4 is provided above the ring 6 with an annular mounting body or ring 18 forming an annular chamber 19. This body 18 is formed by a lower plate 20 welded to the collar 4, an upper plate 21 welded to the collar 4, and an outer body 22 connecting the outer peripheries of the annular plates 20 and 21 and formed with throughgoing holes 23 that vent the compartment 19 to the ambient atmosphere. Flexible connections 24 are provided between the upper ends of the rods 5 and the body 18 so that air exiting from these upper ends 17 enters the compartment 19 and can exit to the ambient air via the apertures 23.

The crucible 1 here is shown lined with refractory bricks 25, and surrounded by a housing having a side wall 26 and a bottom wall 27 that contains the coil 11 and its flux-return or conducting element 12.

The body 18 extends radially outwardly from the axis A considerably further than any of the other structure of the crucible and rests via a seal 29 on the upper rim 28 of the housing 26. Furthermore a protection skirt 30 is provided on the lower portion of the crucible 1, welded to the ring 7, to protect the connection tubes 16 when the crucible 1 is lowered into the heating apparatus.

A hood 31 connected via an exhaust conduit 34 to an evacuation pump 54 has a rim 32 resting via a seal 33 on the upper plate 21 of the body 18. Thus a closed space is defined below the hood 31 and inside the crucible 1 so that the interior can be either evacuated, or filled with an inert gas.

Figure 4:
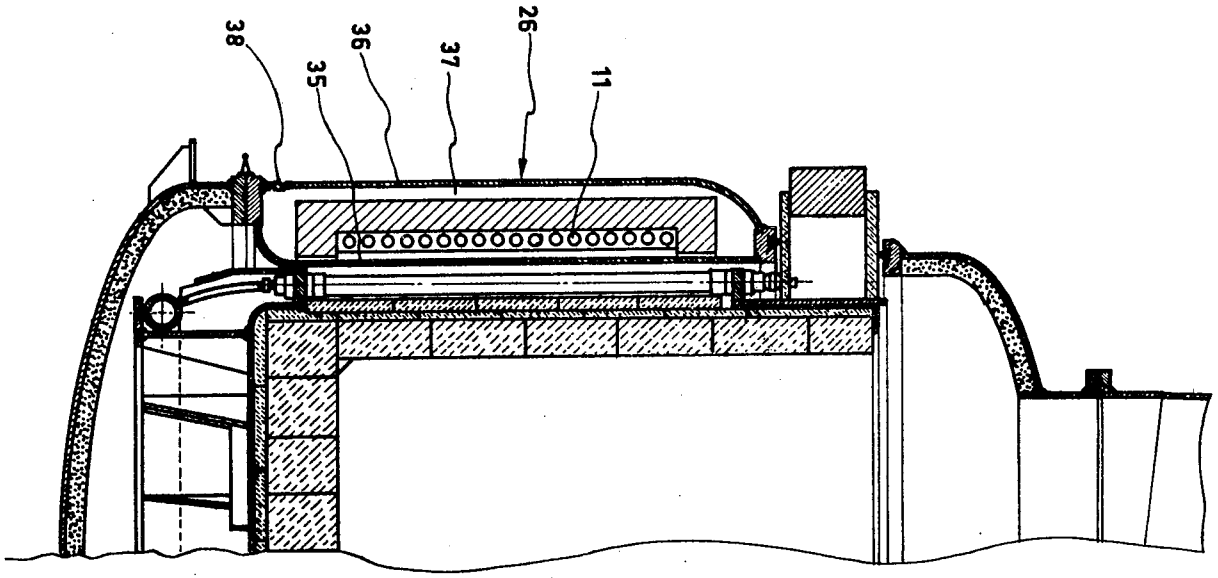
FIG. 4 is a vertical section similar to FIG. 3 illustrating an alternative arrangement for the induction heater according to this invention.

FIG. 4 shows how a partition 35 can coact with an outer wall 36 of the housing 26 to form an annular chamber 37 that contains the coil 11. A hole 38 formed in the outer wall 36 is connected via a conduit to a valve 56 that can either vent it at 57 or connect it to a conduit 58 that in turn is connected to the exhaust conduit 34 of the system. Thus when opened in the direction of outlet tube 57 the interior of the chamber 37 is exposed to atmospheric air, but when connected to the conduit 58 instead it is evacuated.

This last-described arrangement makes it possible to use relatively high voltages, indeed in the order of 250 V, without damage to the coil 11. Such an arrangement, therefore, can be operated at much higher than normal voltage. To this end the partition 35 is formed of nonmagnetic material that has good resistance to high temperature. For example it is possible to use a thermoplastic synthetic resin such as rigid polyvinylchloride such as sold under the tradename "Lucoflex," or asbestos reinforced with araldite, or even synthetic-resins reinforced with glass fiber. It is also of course possible to simply surround the coil 11 with an inert insulating gas.

FIG. 5 shows how each tube 5 has a hollow interior 39 and is provided at its upper and lower ends with welded-on internally threaded sleeves 40. A metal washer 41 and an insulating washer 42 lies between each sleeve 40 and the respective ring 6 or 7, and another such metal washer 41' and insulating washer 42' lies to the other side of the respective ring 6 or 7. An insulating sleeve 46 is provided between the washers 42 and 42' on each side so that a double-threaded connecting piece 43 can pass through the respective mounting ring 6 or 7 without making electrical contact therewith. In addition each connecting piece 43 has an upper end 44 onto which is threaded a nut 45 bearing via belleville washers on the respective metal washer 41'. The upper end 44 of the upper connecting piece 43 has a recess 47 in which is fitted a nipple 48 carried on the lower end of the respective flexible coupling 24.

A nut 51 having a central throughgoing hole is secured via threads 52 in the lower plate 20 and has a nipple 50 fitting into the upper end of the elastic connecting cuff 24. Thus the interior 39 of each tube 5 is directly connected with the compartment 19 of the body 18. The apertures 23 are sufficiently large to allow an assembler to reach through them with a wrench to hold and tighten the nuts 51.

Furthermore the tubes 5 are completely insulated from the rings 6 and 7 at the holes 59 and 59' where they pass through them. The connector 49 is also made of insulating material, and the connectors 16 are similarly elastic and insulating. Each of the tubes 5, therefore, forms an open circuit which will heat up very little due to Foucault currents, and which will also be individually cooled.

It will be understood that each of the elements described above, or two or more together, may also find a useful application in other types of structures differing from the types described above.

While the invention has been illustrated and described as embodied in an induction heating apparatus, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A metallurgical crucible comprising:
- a metallic base pan;
- a metallic holding collar;
- upper and lower mounting rings respectively on said collar and pan;
- a lining of refractory material between said base pan and said collar;
- a plurality of upright and tubular tierods extending between said rings and spaced angular about said lining;
- means for securing said rods to said rings and thereby clamping said lining in place between said base pan and said collar; and
- means for circulating a cooling fluid through said tubular tierods.

2. The crucible defined in claim 1, wherein said crucible is intended for use within an upwardly cupped induction coil having an upper rim, said crucible further comprising an annular upper support body secured to said collar above said upper ring and extending outwardly beyond said upper ring, said body being formed with an annular compartment, whereby said crucible can be supported on said rim by said support body; and connection means between the upper end of each of said tierods and said compartment of said body for communication between the hollow interiors of said tierods and said compartment, said means for circulating being effective to force said coolant fluid upwardly through said tierods and into said compartment.

3. The crucible defined in claim 2, wherein said annular body is formed by a pair of vertically spaced annular plates having inner peripheries secured to said collar and having outer peripheries and by an outer annular body vertically interconnecting said outer peripheries and forming said compartment with said plates and said collar.

4. The crucible defined in claim 3, wherein said outer annular body is generally cylindrical and is formed with throughgoing apertures, whereby said compartment is open through said apertures to the ambient atmosphere.

5. A metallurgical induction heating apparatus comprising:
- an upwardly cupped induction heater having an upper rim;
- a crucible fittable within said heater and including
  - a metallic base pan,
  - a metallic holding collar,
  - upper and lower mounting rings respectively on said collar and pan,
  - a lining of refractory material between said base pan and said collar,
  - a plurality of upright and tubular tierods extending between said rings and spaced angularly about said lining,
  - means for securing said rods to said rings and thereby clamping said lining in place between said base pan and said collar,
  - an annular upper support body secured to said collar above and extending outwardly beyond said upper ring and formed with an annular compartment open to the ambient atmosphere, and
  - connection means between the upper end of each of said tierods and said compartments of said body;

and
- means for circulating a coolant fluid upwardly through said tierods and into said compartment.

6. The apparatus defined in claim 5, wherein said induction heater has an outer housing forming said rim, a coil in said housing, and a partition subdividing said housing into a pair of unconnected chambers one of which contains said coil.

7. The apparatus defined in claim 6, wherein said housing has at least one throughgoing aperture at said one chamber, whereby said one chamber is open through said one aperture to the ambient atmosphere.

8. The apparatus defined in claim 5; further comprising a tight cover engageable over said crucible and forming a closed space with said lining thereof; and means for at least partially evacuating said space.

9. The apparatus defined in claim 8, wherein said induction heater has an outer housing forming said rim, a coil in said housing, and a partition subdividing said housing into a pair of separate unconnected chambers one of which contains said coil, said apparatus further comprising a conduit between said one chamber and said means for evacuating for at least partial evacuation of said one chamber.

* * * * *